US006076712A

United States Patent [19]

Esber et al.

[11] Patent Number: 6,076,712

[45] Date of Patent: Jun. 20, 2000

[54] FLEXIBLE CAULK TUBE NOZZLE

[76] Inventors: Alex S. Esber, 4924 81st Ave.; George A. Mallette, Jr., 2823 N. Lemon Ave., both of Sarasota, Fla. 34234

[21] Appl. No.: 09/177,241

[22] Filed: Oct. 22, 1998

[51] Int. Cl.[7] ..... B67D 3/00

[52] U.S. Cl. ..... 222/527; 222/568; 222/570

[58] Field of Search ..... 222/326, 527, 222/567, 570, 573

[56] References Cited

U.S. PATENT DOCUMENTS

| | | | |
|---|---|---|---|
| 3,330,450 | 7/1967 | Clare | 222/567 |
| 3,886,711 | 6/1975 | Brothers et al. | 53/14 |
| 4,921,147 | 5/1990 | Poirier | 222/527 |
| 4,957,225 | 9/1990 | Childers | 222/568 |
| 5,029,738 | 7/1991 | Dillon | 222/527 |
| 5,033,951 | 7/1991 | Cook | 425/87 |
| 5,154,327 | 10/1992 | Long | 222/326 |
| 5,249,716 | 10/1993 | O'Sullivan | 222/527 X |
| 5,249,876 | 10/1993 | Hattman | 401/261 |
| 5,346,380 | 9/1994 | Ables | 425/87 |
| 5,588,560 | 12/1996 | Benedict et al. | 222/106 |

*Primary Examiner*—Joseph A. Kaufman
*Assistant Examiner*—Thach Bui
*Attorney, Agent, or Firm*—Joseph N. Breaux

[57] ABSTRACT

A flexible caulk tube nozzle that includes a tapered nozzle end portion, an accordion flexible section, a caulk tube attachment portion, and a number of angled caulk tube gripping structures. The tapered nozzle end portion, the accordion flexible section, and the caulk tube attachment portion are integrally formed to define an internal caulk passageway through the tapered nozzle end portion, the accordion flexible section and the caulk tube attachment portion. The caulk tube attachment portion defines a caulk tube insertion opening in connection with the internal caulk passageway. Each of the plurality of angled caulk tube gripping structures has a bevel edged internal caulk tube engaging portion that extends into the internal caulk passageway adjacent to the caulk tube insertion opening in a manner such that as the flexible caulk tube nozzle is screwed onto a caulk tube, the bevel edged internal caulk tube engaging portions each cut into and engage the caulk tube.

1 Claim, 2 Drawing Sheets

FLEXIBLE CAULK TUBE NOZZLE

TECHNICAL FIELD

The present invention relates to nozzles for dispensing caulking and similar viscous mixtures and more particularly to a flexible caulk tube nozzle that is securable over the dispensing tube of a caulk container that includes a tapered nozzle end portion, an accordion flexible section, a caulk tube attachment portion, and a plurality of angled caulk tube gripping structures; the tapered nozzle end portion, the accordion flexible section, and the caulk tube attachment portion being integrally formed to define an internal caulk passageway through the tapered nozzle end portion, the accordion flexible section and the caulk tube attachment portion; the caulk tube attachment portion defining a caulk tube insertion opening in connection with the internal caulk passageway; each of the plurality of angled caulk tube gripping structures having a bevel edged internal caulk tube engaging portion extending into the internal caulk passageway adjacent to the caulk tube insertion opening in a manner such that as the flexible caulk tube nozzle is screwed onto a caulk tube, the bevel edged internal caulk tube engaging portions each cut into and engage the caulk tube.

BACKGROUND ART

Caulking is typically used to provide a resilient seal between two adjacent structures, such as a window frame and a brick wall, to prevent water and air from entering the gap between the two adjacent structures. Although caulking is desirable, it is often difficult to dispense the viscous caulk into the gap between the structures with the straight, tapered caulk tube conventionally provided with the caulk container. It would be a benefit, therefore, to have a caulk tube nozzle that was attachable over the caulk tube of the caulk container and which was sufficiently flexible to allow a tapered nozzle end portion of the caulk tube nozzle to be oriented at a number of desirable angles with respect to a caulk tube attachment portion of the caulk tube nozzle. Additionally, because caulk is highly viscous, it could be difficult to maintain a caulk tube nozzle on the caulk tube. It would be a further benefit, therefore, to have a caulk tube nozzle that included a number of caulk tube gripping structures that could cut into and engage the sidewall of the caulk tube to prevent the caulk tube nozzle from being forced off the caulk tube by caulk flowing through the caulk tube nozzle.

GENERAL SUMMARY DISCUSSION OF INVENTION

It is thus an object of the invention to provide a caulk tube nozzle that is flexible.

It is a further object of the invention to provide a flexible caulk tube nozzle that includes a number of caulk tube gripping structures that cut into and engage the sidewall of the caulk tube to prevent the caulk tube nozzle from being forced off the caulk tube by caulk flowing through the caulk tube nozzle.

It is a still further object of the invention to provide a flexible caulk tube nozzle that includes a tapered nozzle end portion, an accordion flexible section, a caulk tube attachment portion, and a plurality of angled caulk tube gripping structures; the tapered nozzle end portion, the accordion flexible section, and the caulk tube attachment portion being integrally formed to define an internal caulk passageway through the tapered nozzle end portion, the accordion flexible section and the caulk tube attachment portion; the caulk tube attachment portion defining a caulk tube insertion opening in connection with the internal caulk passageway; each of the plurality of angled caulk tube gripping structures having a bevel edged internal caulk tube engaging portion extending into the internal caulk passageway adjacent to the caulk tube insertion opening in a manner such that as the flexible caulk tube nozzle is screwed onto a caulk tube, the bevel edged internal caulk tube engaging portions each cut into and engage the caulk tube.

It is a still further object of the invention to provide a flexible caulk tube nozzle that accomplishes some or all of the above objects in combination.

Accordingly, a flexible caulk tube nozzle is provided. The flexible caulk tube nozzle includes a tapered nozzle end portion, an accordion flexible section, a caulk tube attachment portion, and a plurality of angled caulk tube gripping structures; the tapered nozzle end portion, the accordion flexible section, and the caulk tube attachment portion being integrally formed to define an internal caulk passageway through the tapered nozzle end portion, the accordion flexible section and the caulk tube attachment portion; the caulk tube attachment portion defining a caulk tube insertion opening in connection with the internal caulk passageway; each of the plurality of angled caulk tube gripping structures having a bevel edged internal caulk tube engaging portion extending into the internal caulk passageway adjacent to the caulk tube insertion opening in a manner such that as the flexible caulk tube nozzle is screwed onto a caulk tube, the bevel edged internal caulk tube engaging portions each cut into and engage the caulk tube.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
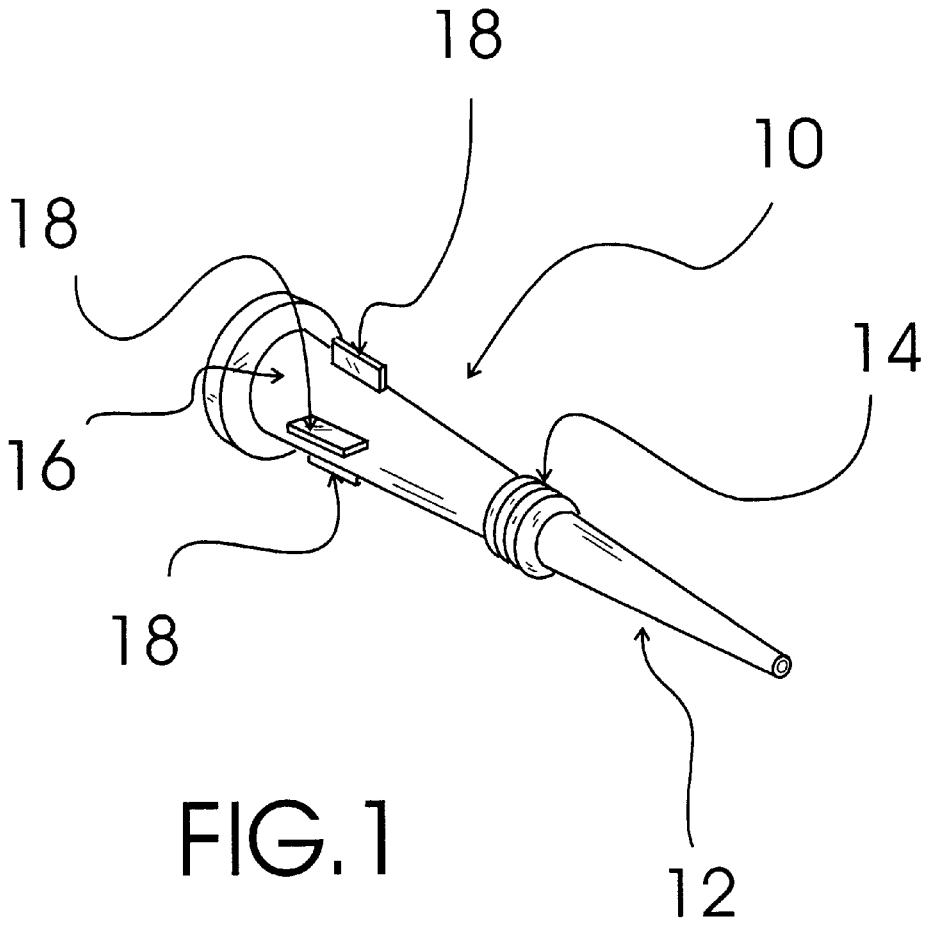
FIG. 1 is a perspective view of an exemplary embodiment of the flexible caulk tube nozzle of the present invention showing the tapered nozzle end portion, the accordion flexible section, the caulk tube attachment portion, and three of the four angled caulk tube gripping structures.

FIG. 1 is a perspective view of an exemplary embodiment of the flexible caulk tube nozzle of the present invention generally designated 10. Flexible caulk tube nozzle 10 includes a tapered nozzle end portion, generally designated 12; an accordion flexible section, generally designated 14; a caulk tube attachment portion, generally designated 16; and four angled caulk tube gripping structures, generally designated 18. Tapered nozzle end portion 12, accordion flexible section 14, caulk tube attachment portion 16 and the four angled caulk tube gripping structures 18 are unitarily molded of plastic.

Figure 2:
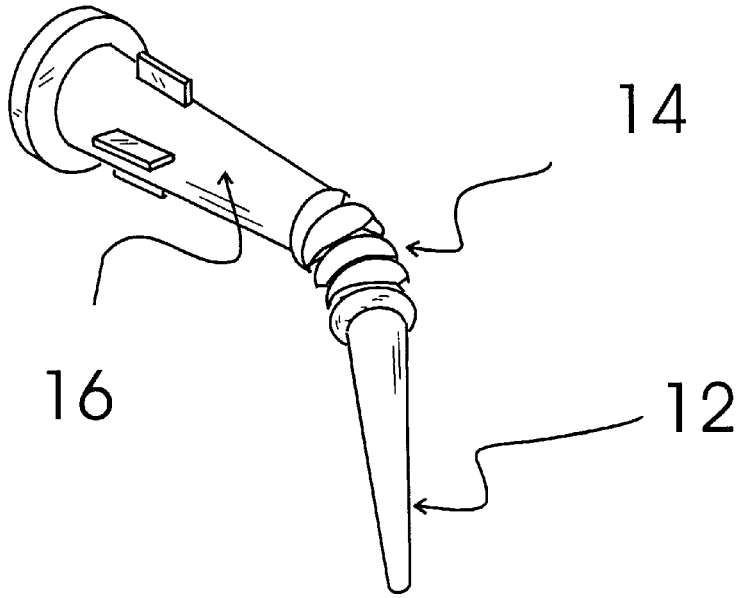
FIG. 2 is a perspective view of the exemplary flexible caulk tube nozzle of FIG. 1 with the accordion flexible section bent to orient the tapered nozzle end portion at a ninety degree angle with respect to the caulk tube attachment portion.
Figure 3:
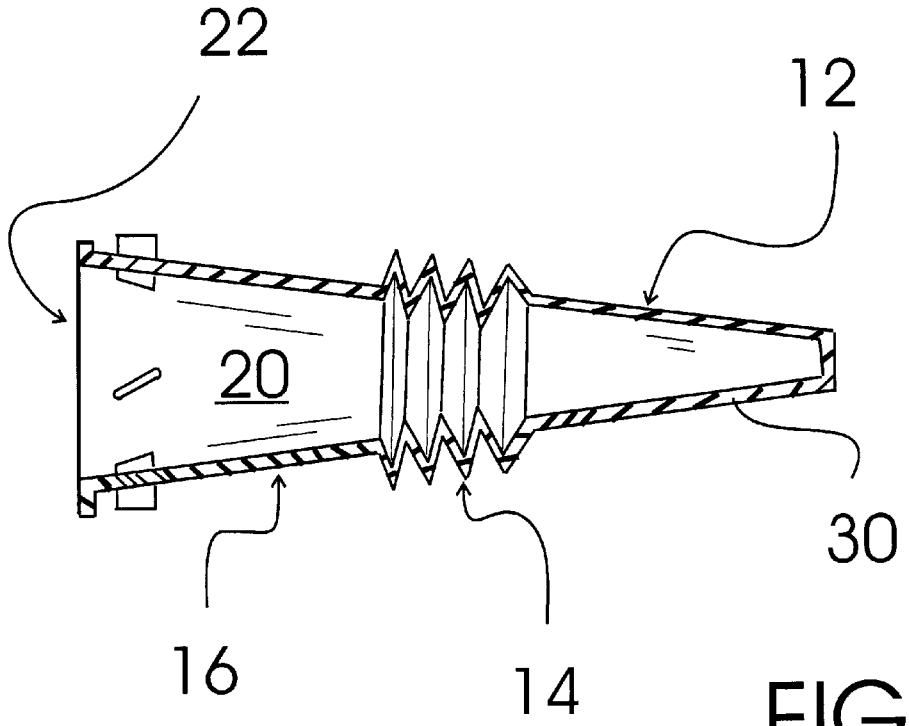
FIG. 3 is longitudinal cross section view through the flexible caulk tube nozzle of FIG. 1 showing the internal caulk passageway formed through the tapered nozzle end portion, the accordion flexible section and the caulk tube attachment portion; and the bevel edged internal caulk tube engaging portions of three of the four angled caulk tube gripping structures.
Figure 4:
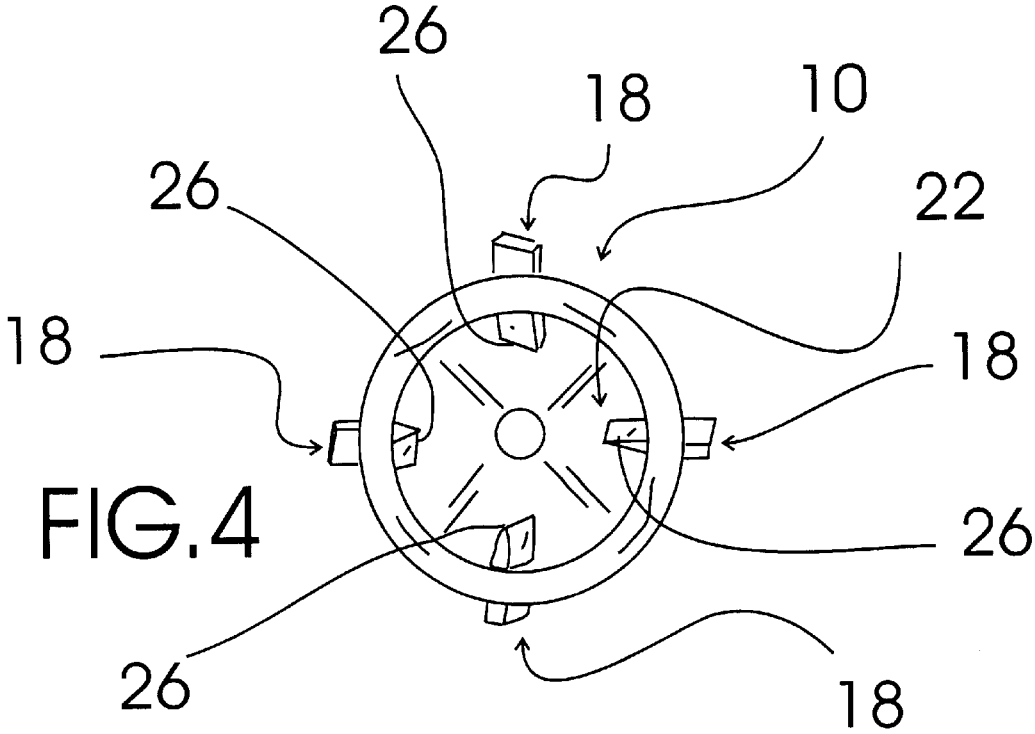
FIG. 4 is an end plan view of the caulk tube attachment portion end of the flexible caulk tube nozzle of FIG. 1 showing the caulk tube insertion opening and the bevel edged internal caulk tube engaging portions of the four angled caulk tube gripping structures.

With reference to FIG. 2, accordion flexible section 14 is positioned between tapered nozzle end portion 12 and caulk tube attachment portion 16 and provides a mechanism for orienting tapered nozzle end portion 12 at a desired angle with respect to caulk tube attachment portion 16. Referring now to FIG. 3, an internal caulk passageway 20 is formed through and within tapered nozzle end portion 12, accordion flexible section 14 and caulk tube attachment portion 16. In use, a caulk tube from a caulk container is inserted into internal caulk passageway 20 through a caulk tube insertion opening 22 (see also FIG. 4). Referring to FIG. 4, each of the four angled caulk tube gripping structures 18 includes a bevel edged internal caulk tube engaging portion 26 that extends at an angle into the internal caulk passageway 20 (FIG. 3) adjacent to caulk tube insertion opening 22 in a manner such that as flexible caulk tube nozzle 10 is screwed onto the end of a caulk tube, the bevel edged internal caulk tube engaging portions 26 each cut a spiral thread into and engage the caulk tube. Referring back to FIG. 3, a tip end 30 of tapered nozzle end portion 12 is snipped or cut off by the user to provide a caulk discharge orifice of the desired size.

It can be seen from the preceding description that a flexible caulk tube nozzle has been provided that includes a number of caulk tube gripping structures that cut into and engage the sidewall of the caulk tube to prevent the caulk tube nozzle from being forced off the caulk tube by caulk flowing through the caulk tube nozzle.; and that includes a tapered nozzle end portion, an accordion flexible section, a caulk tube attachment portion, and a plurality of angled caulk tube gripping structures; the tapered nozzle end portion, the accordion flexible section, and the caulk tube attachment portion being integrally formed to define an internal caulk passageway through the tapered nozzle end portion, the accordion flexible section and the caulk tube attachment portion; the caulk tube attachment portion defining a caulk tube insertion opening in connection with the internal caulk passageway; each of the plurality of angled caulk tube gripping structures having a bevel edged internal caulk tube engaging portion extending into the internal caulk passageway adjacent to the caulk tube insertion opening in a manner such that as the flexible caulk tube nozzle is screwed onto a caulk tube, the bevel edged internal caulk tube engaging portions each cut into and engage the caulk tube.

It is noted that the embodiment of the flexible caulk tube nozzle described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A flexible caulk tube nozzle that is attachable to a caulk tube of a caulk container, said flexible caulk tube nozzle comprising:

a tapered nozzle end portion;

an accordion flexible section;

a caulk tube attachment portion; and four angled caulk tube gripping structures;

said tapered nozzle end portion, said accordion flexible section, and said caulk tube attachment portion being integrally formed to define an internal caulk passageway through said tapered nozzle end portion, said accordion flexible section and said caulk tube attachment portion;

said caulk tube attachment portion defining a caulk tube insertion opening in connection with said internal caulk passageway;

each of said four angled caulk tube gripping structures having a bevel edged internal caulk tube engaging portion extending into said internal caulk passageway adjacent to said caulk tube insertion opening in a manner such that as said flexible caulk tube nozzle is screwed onto a caulk tube, said bevel edged internal caulk tube engaging portions each cut a spiral thread into and engage the caulk tube.

* * * * *